US007887649B2

(12) United States Patent
Toyoda et al.

(10) Patent No.: US 7,887,649 B2
(45) Date of Patent: Feb. 15, 2011

(54) HIGH-TENSILE STRENGTH WELDED STEEL TUBE FOR STRUCTURAL PARTS OF AUTOMOBILES AND METHOD OF PRODUCING THE SAME

(75) Inventors: Shunsuke Toyoda, Aichi (JP); Masatoshi Aratani, Aichi (JP); Yoshikazu Kawabata, Aichi (JP); Yuji Hashimoto, Aichi (JP); Koji Suzuki, Aichi (JP); Kei Sakata, Aichi (JP); Makio Gunji, Aichi (JP); Akio Sato, Aichi (JP); Tetsuro Sawaki, Aichi (JP)

(73) Assignee: JFE Steel Corporation (JP)

( * ) Notice: Subject to any disclaimer, the term of this patent is extended or adjusted under 35 U.S.C. 154(b) by 170 days.

(21) Appl. No.: 12/307,439

(22) PCT Filed: Jun. 19, 2007

(86) PCT No.: PCT/JP2007/062651

§ 371 (c)(1),
(2), (4) Date: Mar. 11, 2009

(87) PCT Pub. No.: WO2008/004453

PCT Pub. Date: Jan. 10, 2008

(65) Prior Publication Data

US 2009/0277544 A1 Nov. 12, 2009

(30) Foreign Application Priority Data

Jul. 5, 2006 (JP) ..... 2006-185810

(51) Int. Cl.
*C21D 9/08* (2006.01)
*C22C 38/00* (2006.01)
*C21D 8/02* (2006.01)

(52) U.S. Cl. ..... 148/519; 148/320; 148/601

(58) Field of Classification Search ..... 148/320, 148/519, 601
See application file for complete search history.

(56) References Cited

U.S. PATENT DOCUMENTS 6,290,789 B1 * 9/2001 Toyooka et al. ..... 148/593
7,018,488 B2 * 3/2006 Toyooka et al. ..... 148/320

FOREIGN PATENT DOCUMENTS

| | | | |
|---|---|---|---|
| EP | 1 134 047 | A2 | 9/2001 |
| EP | 1640468 | A1 * | 3/2006 |
| JP | 2001-321846 | A | 11/2001 |
| JP | 2003-321746 | A | 11/2003 |
| JP | 2003-321747 | A | 11/2003 |
| JP | 2003-321748 | A | 11/2003 |
| JP | 2007-217736 | A | 8/2007 |

* cited by examiner

*Primary Examiner*—Jessica L Ward
*Assistant Examiner*—Alexander Polyansky
(74) *Attorney, Agent, or Firm*—DLA Piper LLP (US)

(57) ABSTRACT

A high-tensile strength welded steel tube has excellent formability and torsional fatigue endurance after being formed into cross-sectional shape and then stress-relief annealed. A steel material used has a composition which contains C, Si, Al, 1.01% to 1.99% Mn, 0.041% to 0.150% Ti, 0.017% to 0.150% Nb, P, S, N, and O such that the sum of the content of Ti and that of Nb is 0.08% or more, the content of each of C, Si, and Al being within an appropriate range, the content of each of P, S, N, and O being adjusted to a predetermined value or less.

6 Claims, 3 Drawing Sheets

HIGH-TENSILE STRENGTH WELDED STEEL TUBE FOR STRUCTURAL PARTS OF AUTOMOBILES AND METHOD OF PRODUCING THE SAME

RELATED APPLICATIONS

This is a §371 of International Application No. PCT/JP2007/062651, with an international filing date of Jun. 19, 2007 (WO 2008/004453 A1, published Jan. 1, 2008), which is based on Japanese Patent Application No. 2006-185810, filed Jul. 5, 2006.

TECHNICAL FIELD

This disclosure relates to high-tensile strength welded steel tubes, having a yield strength of greater than 660 MPa, suitable for automobile structural parts such as torsion beams, axle beams, trailing arms, and suspension arms. In particular, it relates to a high-tensile strength welded steel tube which is used for torsion beams and which has excellent formability and high torsional fatigue endurance after the tube is formed into cross-sectional shape and is then stress-relief annealed and also relates to a method of producing the high-tensile strength welded steel tube.

BACKGROUND

In recent years, in view of global environmental conservation, it has been strongly required that automobiles are improved in fuel efficiency. Therefore, the drastic weight reduction of the bodies of automobiles and the like is demanded. Even structural parts of automobiles and the like are no exception. To achieve a good balance between weight reduction and safety, high-strength electrically welded steel tubes are used for some of the structural parts. Conventional electrically welded steel tubes used as raw materials have been formed so as to have a predetermined shape and then subjected to thermal refining such as quenching, whereby high-strength structural parts have been obtained. However, the use of thermal refining causes the following problems: an increase in the number of production steps, an increase in the time taken to produce structural parts, and an increase in the production cost of the structural parts.

To cope with the problems, Japanese Patent No. 2588648 discloses a method of producing an ultra-high tensile strength electrically welded steel tube for structural parts of automobiles and the like. In the method disclosed in Japanese Patent No. 2588648, a steel material in which the content of C, Si, Mn, P, S, Al, and/or N is appropriately adjusted and which contains 0.0003% to 0.003% B and one or more of Mo, Ti Nb, and V is finish-rolled at a temperature ranging from its Ar3 transformation point to 950° C. and is then hot-rolled into a steel strip for tubes in such a manner that the steel material is coiled at 250° C. or lower, the steel strip is formed into an electrically welded steel tube, and the electrically welded steel tube is aged at a temperature of 500° C. to 650° C. According to the method, an ultra-high tensile strength steel tube having a tensile strength of greater than 1000 MPa can be obtained without performing thermal refining because of transformation strengthening due to B and precipitation hardening due to Mo, Ti, and/or Nb.

Japanese Patent No. 2814882 discloses a method of producing an electrically welded steel tube suitable for door impact beams and stabilizers of automobiles and which has a high tensile strength of 1470 N/mm$^2$ or more and high ductility. In the method disclosed in Japanese Patent No. 2814882, the electrically welded steel tube is produced from a steel sheet made of a steel material which contains 0.18% to 0.28% C, 0.10% to 0.50% Si, 0.60% to 1.80% Mn, 0.020% to 0.050% Ti, 0.0005% to 0.0050% B, and one or more of Cr, Mo, and Nb and in which the amount of P and S is appropriately adjusted; is normalized at a temperature of 850° C. to 950° C., and is then quenched. According to this method, an electrically welded steel tube having a high strength of 1470 N/mm$^2$ or more and a ductility of about 10% to 18% can be obtained. This electrically welded steel tube is suitable for door impact beams and stabilizers of automobiles.

An electrically welded steel tube produced by the method disclosed in Japanese Patent No. 2588648 has a small elongation El of 14% or less and low ductility and therefore is low in formability; hence, there is a problem in that the tube is unsuitable for automobile structural parts, such as torsion beams and axle beams, made by press forming or hydro-forming.

An electrically welded steel tube produced by the method disclosed in Japanese Patent No. 2814882 has an elongation El of up to 18% and is suitable for stabilizers formed by bending. However, this tube has ductility insufficient to produce structural parts by press forming or hydro-forming. Therefore, there is a problem in that this tube is unsuitable for automobile structural parts, such as torsion beams and axle beams, made by press forming or hydro-forming. Furthermore, the method disclosed in Japanese Patent No. 2814882 requires normalizing and quenching, is complicated, and is problematic in dimensional accuracy and economic efficiency.

It could therefore be helpful to provide a high-tensile strength welded steel tube which is suitable for automobile structural parts such as torsion beams and which is required to have excellent torsional fatigue endurance after the tube is formed into cross-sectional shape and is then stress-relief annealed. It could also be helpful to provide a method of producing an electrically welded steel tube for structural parts of automobiles without performing thermal refining. This tube would have a yield strength of greater than 660 MPa, excellent low-temperature toughness, excellent formability, and excellent torsional fatigue endurance after this tube is formed into cross-sectional shape and is then stress-relief annealed.

SUMMARY

The term "high-tensile strength welded steel tube" used herein means a welded steel tube with a yield strength YS of greater than 660 MPa.

The term "excellent formability" used herein means that a JIS #12 test specimen according to JIS Z 2201 has an elongation El of 15% or more (22% or more for a JIS #11 test specimen) as determined by a tensile test according to JIS Z 2241.

The term "excellent torsional fatigue endurance after forming into cross-sectional shape and then stress-relief annealing" used herein means that a steel tube has a $\sigma_B$/Ts ratio of 0.40 or more, wherein $\sigma_B$ represents the $5\times10^5$-cycle fatigue limit of the steel tube and TS represents the tensile strength of the steel tube. The $5\times10^5$-cycle fatigue limit of the steel tube is determined in such a manner that a longitudinally central portion of the steel tube is formed so as to have a V-shape in cross section as shown in FIG. 3 (FIG. 11 of Japanese Unexamined Patent Application Publication No. 2001-321846), the resulting steel tube is stress-relief annealed at 530° C. for ten minutes, both end portions of the steel tube are fixed by chucking, and the steel tube is then subjected to a torsional fatigue test under completely reversed torsion at 1. Hz for $5\times10^5$ cycles. The "excellent torsional fatigue endurance after forming into cross-sectional shape and then stress-relief annealing" can be achieved in such a manner that forming into cross-sectional shape is performed as described above and stress-relief annealing is performed at 530° C. for ten minutes such that a rate of change in cross-sectional hardness of −15% or more and a rate of reduction in residual stress of 50% or more are satisfied.

The term "excellent low-temperature toughness" used herein means that the following specimens both exhibit a fracture appearance transition temperature vTrs of 40° C. or lower in a Charpy impact test: a V-notched test specimen (¼-sized) prepared in such a manner that a longitudinally central portion of a test material (steel tube) is formed so as to have a V-shape in cross section as shown in FIG. 3 (FIG. 11 of Japanese Unexamined Patent Application Publication No. 2001-321846), a flat portion of the test material is expanded such that the circumferential direction (C-direction) of a tube corresponds to the length direction of the test specimen, and the flat portion thereof is then cut out therefrom in accordance with JIS Z 2242 and a V-notched test specimen (¼-sized) prepared in such a manner that a longitudinally central portion of a test material (steel tube) is formed so as to have a V-shape in cross section as shown in FIG. 3 (FIG. 11 of Japanese Unexamined Patent Application Publication No. 2001-321846), the resulting test specimen is stress-relief annealed at 530° C. for ten minutes, a flat portion of the test material is expanded such that the circumferential direction of a tube corresponds to the length direction of the test specimen, and the flat portion thereof is then cut out therefrom in accordance with JIS Z 2242.

We conducted intensive systematic research on factors affecting ambivalent properties such as strength, low-temperature toughness, formability, torsional fatigue endurance after forming into cross-sectional shape and then stress-relief annealing and particularly on chemical components and production conditions of steel tubes. As a result, we found that a high-tensile strength welded steel tube that has a yield strength of greater than 660 MPa, excellent low-temperature toughness, excellent formability, and excellent torsional fatigue endurance after being formed into cross-sectional shape and then stress-relief annealed can be produced in such a manner that a steel material (slab) in which the content of C, Si, Mn, and/or Al is adjusted within an appropriate range and which contains Ti and Nb is hot-rolled, under appropriate conditions, into a steel tube material (hot-rolled steel strip) in which a ferrite phase having an average grain size of 2 μm to 8 μm in circumferential cross section occupies 60 volume percent thereof and which has a microstructure in which a (Nb, Ti) composite carbide having an average grain size of 2 nm to 40 nm is precipitated in the ferrite phase, and the steel tube material is subjected to an electrically welded tube-making step under appropriate conditions such that a welded steel tube (electrically welded steel tube) is formed.

We thus provide:

(1) A high-tensile strength welded steel tube, having excellent low-temperature toughness, formability, and torsional fatigue endurance after being stress-relief annealed, for structural parts of automobiles has a composition which contains 0.03% to 0.24% C, 0.002% to 0.95% Si, 1.01% to 1.99% Mn, and 0.01% to 0.08% Al, which further contains 0.041% to 0.150% Ti and 0.017% to 0.150% Nb such that the sum of the content of Ti and that of Nb is 0.08% or more, and which further contains 0.019% or less P, 0.020% or less S, 0.010% or less N, and 0.005% or less O on a mass basis, the remainder being Fe and unavoidable impurities, P, S, N, and O being impurities; a microstructure containing a ferrite phase and a second phase other than the ferrite phase; and a yield strength of greater than 660 MPa. The ferrite phase has an average grain size of 2 μm to 8 μm in circumferential cross section and a microstructure fraction of 60 volume percent or more and contains a precipitate of a (Nb, Ti) composite carbide having an average grain size of 2 nm to 40 nm.

(2) In the high-tensile strength welded steel tube specified in Item (1), the composition further contains one or more selected from the group consisting of 0.001% to 0.150% V, 0.001% to 0.150% W, 0.001% to 0.45% Cr, 0.001% to 0.24% Mo, 0.0001% to 0.0009% B, 0.001% to 0.45% Cu, and 0.001% to 0.45% Ni and/or 0.0001% to 0.005% Ca on a mass basis.

(3) In the high-tensile strength welded steel tube specified in Item (1) or (2), the inner and outer surfaces of the tube have an arithmetic average roughness Ra of 2 μm or less, a maximum-height roughness Rz of 30 μm or less, and a ten-point average roughness $Rz_{JIS}$ of 20 μm or less.

(4) A method of producing a high-tensile strength welded steel tube having a yield strength of greater than 660 MPa, excellent low-temperature toughness, excellent formability, and excellent torsional fatigue endurance after being stress-relief annealed, for structural parts of automobiles includes an electrically welded tube-making step of forming a steel tube material into a welded steel tube. The steel tube material is a hot-rolled steel strip that is obtained in such a manner that a steel material is subjected to a hot-rolling step including a hot-rolling sub-step of heating the steel material to a temperature 1160° C. to 1320° C. and then finish-rolling the steel material at a temperature of 760° C. to 980° C., a slow cooling sub-step of slow cooling the rolled steel material at a temperature of 650° C. to 750° C. for 2 s or more, and a coiling sub-step of coiling the annealed steel material at a temperature of 510° C. to 660° C. The steel material has a composition which contains 0.03% to 0.24% C, 0.002% to 0.95% Si, 1.01% to 1.99% Mn, and 0.01% to 0.08% Al, which further contains 0.041% to 0.150% Ti and 0.017% to 0.150% Nb such that the sum of the content of Ti and that of Nb is 0.08% or more, and which further contains 0.019% or less P, 0.020% or less S, 0.010% or less N, and 0.005% or less O on a mass basis, the remainder being Fe and unavoidable impurities, P, S, N, and O being impurities. The electrically welded tube-making step includes a tube-making step of continuously roll-forming the steel tube material at a width reduction of 10% or less and then electrically welding the steel tube material into the welded steel tube. The width reduction of the steel tube material is defined by the following equation:

$$\text{width reduction (\%)}=[(\text{width of steel tube material})-\pi\{(\text{outer diameter of product})-(\text{thickness of product})\}]/\pi\{(\text{outer diameter of product})-(\text{thickness of product})\}\times(100\%) \quad (1).$$

(5) In the high-tensile strength welded steel tube-producing method specified in Item (4), the composition further contains one or more selected from the group consisting of 0.001% to 0.150% V, 0.001% to 0.150% W, 0.001% to 0.45% Cr, 0.001% to 0.24% Mo, 0.0001% to 0.0009% B, 0.001% to 0.45% Cu, and 0.001% to 0.45% Ni and/or 0.0001% to 0.005% Ca on a mass basis.

The following tube can be produced at low cost without performing thermal refining: a high-tensile strength welded steel tube having a yield strength of greater than 660 MPa, excellent low-temperature toughness, excellent formability, and excellent torsional fatigue endurance after being stress-relief annealed. This is industrially particularly advantageous. This disclosure is advantageous in remarkably enhancing properties of automobile structural parts.

DETAILED DESCRIPTION

Figure 1:
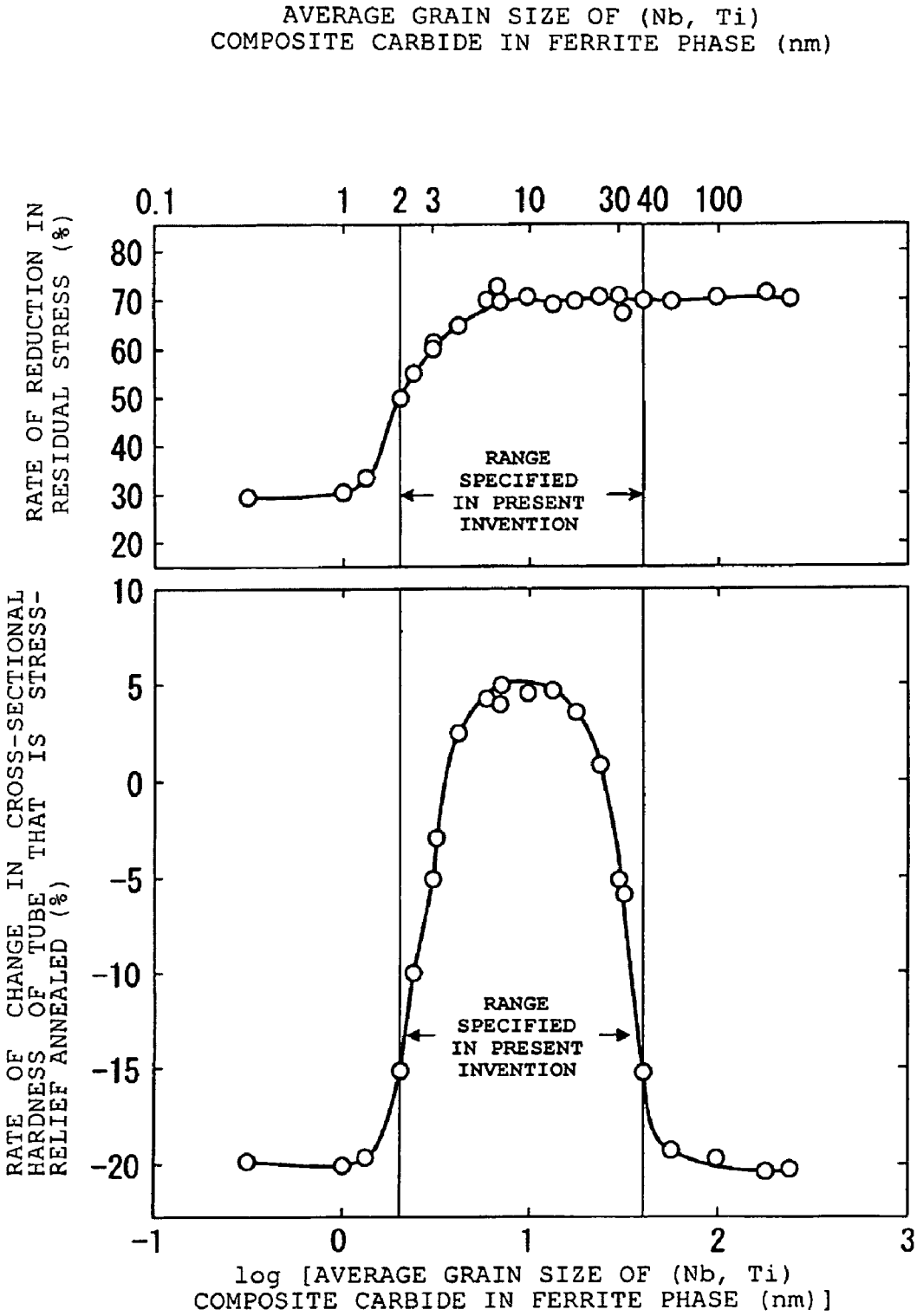
FIG. 1 is a graph showing the relationship between the average grain size of a (Nb, Ti) composite carbide in each ferrite phase, the rate of change in cross-sectional hardness of a tube that is stress-relief annealed, and the rate of change in residual stress of the tube.

Reasons for limiting the composition of a high-tensile strength welded steel tube will now be described. The composition thereof is given in weight percent and is hereinafter simply expressed in %.

C: 0.03% to 0.24%

C is an element that increases the strength of steel and therefore is essential to secure the strength of the steel tube. C is diffused during stress-relief annealing, interacts with dislocations formed in an electrically welded tube-making step or during forming into cross-sectional shape to prevent the motion of the dislocations, prevents the initiation of fatigue cracks, and enhances torsional fatigue endurance. These effects are remarkable when the content of C is 0.03% or more. Meanwhile, when the C content is greater than 0.24%, the steel tube cannot have a ferrite-based microstructure in which a ferrite phase has a fraction of 60 volume percent or more, cannot secure a desired elongation, and has low formability and reduced low-temperature toughness. Therefore, the C content is limited to a range from 0.03% to 0.24% and is preferably 0.05% to 0.14%.

Si: 0.002% to 0.95%

Si is an element that accelerates ferritic transformation in a hot-rolling step. To secure a desired microstructure and excellent formability, the content of Si needs to be 0.002% or more. Meanwhile, when the Si content is greater than 0.95%, the following properties are low: a rate of reduction in residual stress during stress-relief annealing subsequent to forming into cross-sectional shape, torsional fatigue endurance, surface properties, and electric weldability. Therefore, the Si content is limited to a range from 0.002% to 0.95% and is preferably 0.21% to 0.50%.

Mn: 1.01% to 1.99%

Mn is an element that is involved in increasing the strength of steel, affects the interaction between C and the dislocations to prevent the motion of the dislocations, prevents the reduction of strength during stress-relief annealing subsequent to forming into cross-sectional shape, and prevents the initiation of fatigue cracks to enhance torsional fatigue endurance. To achieve such effects, the content of Mn needs to be 1.01% or more. Meanwhile, when the Mn content is greater than 1.99%, a desired microstructure or excellent formability cannot be achieved because ferritic transformation is inhibited. Therefore, the Mn content is limited to a range from 1.01% to 1.99% and is preferably 1.40% to 1.85%.

Al: 0.01% to 0.08%

Al is an element that acts as a deoxidizer during steel making, combines with nitrogen to prevent the growth of austenite grains in a hot-rolling step, and has a function of forming fine crystal grains. To achieve a ferrite phase with a desired grain size (2 μm to 8 μm), the content of Al needs to be 0.01% or more. When the Al content is less than 0.01%, the ferrite phase is course. Meanwhile, when the Al content is greater than 0.08%, its effect is saturated and fatigue endurance is reduced because oxide inclusions are increased. Therefore, the Al content is limited to a range from 0.01% to 0.08% and is preferably 0.02% to 0.06%.

Ti: 0.041% to 0.150%

Ti is an element that combines with N in steel to form TiN, reduces the amount of solute nitrogen, is involved in securing the formability of the steel tube, prevents the growth of recovered or recrystallized grains in a hot-rolling step because surplus Ti other than that combining with N forms a (Nb, Ti) composite carbide, which precipitates, together with Nb, and has a function of allowing a ferrite phase to have a desired grain size (2 μm to 8 μm). Ti further has a function of preventing the reduction of strength during stress-relief annealing subsequent to forming into cross-sectional shape in cooperation with Nb to enhance torsional fatigue endurance. To achieve such effects, the content of Ti needs to be 0.041% or more. Meanwhile, when the Ti content is greater than 0.150%, the carbide precipitate causes a significant increase in strength, a significant reduction in ductility, and a significant reduction in low-temperature toughness. Therefore, the Ti content is limited to a range from 0.041% to 0.0150% and is preferably 0.050% to 0.070%.

Nb: 0.017% to 0.150%

Nb combines with C in steel to form a (Nb, Ti) composite carbide, which precipitates, together with Ti, prevents the growth of recovered or recrystallized grains in a hot-rolling step, and has a function of allowing a ferrite phase to have a desired grain size (2 μm to 8 μm). Furthermore, Nb prevents the reduction of strength during stress-relief annealing subsequent to forming into cross-sectional shape in cooperation with Ti to enhance torsional fatigue endurance. To achieve such effects, the content of Nb needs to be 0.017% or more. Meanwhile, when the Nb content is greater than 0.150%, the carbide precipitate causes a significant increase in strength and a significant reduction in ductility. Therefore, the Nb content is limited to a range from 0.017% to 0.150% and is preferably 0.031% to 0.049%.

Ti+Nb: 0.08% or More

Ti and Nb are contained such that the sum of the content of Ti and that of Nb is 0.08% or more. When the sum of the Ti content and the Nb content is less than 0.08%, a yield strength of greater than 660 MPa or desired torsional fatigue endurance cannot be achieved after stress-relief annealing. In view of achieving excellent ductility, the sum of the Ti content and the Nb content is preferably 0.12% or less.

The content of P, that of S, that of N, and that of O are adjusted to be 0.019% or less, 0.020% or less, 0.010% or less, and 0.005% or less, respectively, P, S, N, and O being impurities.

P: 0.019% or Less

P is an element having an adverse effect, that is, P reduces the low-temperature toughness and electric weldability of the tube that is stress-relief annealed because of the coagulation or co-segregation with Mn; hence, the content of P is preferably low. When the P content is greater than 0.019%, the adverse effect is serious; hence, the P content is limited to 0.019% or less.

S: 0.020% or Less

S is an element having adverse effects, that is, S is present in steel in the form of an inclusion such as MnS and therefore reduces the electric weldability, torsional fatigue endurance, formability, and low-temperature toughness of the steel; hence, the content of S is preferably low. When the S content is greater than 0.020%, the adverse effects are serious; hence, hence, the upper limit of the S content is 0.020%. The S content is preferably 0.002% or less.

N: 0.010% or Less

N is an element having adverse effects, that is, N reduces the formability and low-temperature toughness of the steel tube when N is present in steel in the form of solute N; hence, the content of N is herein preferably low. When the N content is greater than 0.010%, the adverse effects are serious; hence, the upper limit of the N content is 0.010%. The N content is preferably 0.0049% or less.

O: 0.005% or Less

O is an element having adverse effects, that is, O is present in steel in the form of an oxide inclusion and therefore reduces the formability and low-temperature toughness of the steel; hence, the content of O is herein preferably low. When the O content is greater than 0.005%, the adverse effects are serious; hence, the upper limit of the O content is 0.005%. The O content is preferably 0.003% or less.

The above elements are basic components of the tube. The tube may further contain one or more selected from the group consisting of 0.001% to 0.150% V, 0.001% to 0.150% W, 0.001% to 0.45% Cr, 0.001% to 0.24% Mo, 0.0001% to 0.0009% B, 0.001% to 0.45% Cu, and 0.001% to 0.45% Ni and/or 0.0001% to 0.005% Ca in addition to the basic components.

V, W, Cr, Mo, B, Cu, Ni are elements that have a function of preventing the strength of the tube that is formed into cross-sectional shape and is then stress-relief annealed from being reduced due to Mn, a function of preventing the initiation of fatigue cracks, and a function of assisting in enhancing torsional fatigue endurance. The tube may contain one or more selected from these elements as required.

V: 0.001% to 0.150%

V combines with C to form a carbide precipitate and has a function of preventing the growth of recovered or recrystallized grains in a hot-rolling step to allow a ferrite phase to have a desired grain size and a function of assisting in preventing the strength of the tube that is stress-relief annealed from being reduced to enhance torsional fatigue endurance, which are due to Nb in addition to the above functions. To achieve such effects, the content of V is preferably 0.001% or more. When the V content is greater than 0.150%, a reduction in formability is caused. Therefore, the V content is preferably limited to a range from 0.001% to 0.150% and is more preferably 0.04% or less.

W: 0.001% to 0.150%

W, as well as V, combines with C to form a carbide precipitate and has a function of preventing the growth of recovered or recrystallized grains in a hot-rolling step to allow a ferrite phase to have a desired grain size and a function of assisting in preventing the strength of the tube that is stress-relief annealed from being reduced to enhance torsional fatigue endurance, which are due to Nb in addition to the above functions. To achieve such effects, the content of W is preferably 0.001% or more. When the W content is greater than 0.150%, a reduction in formability and/or a reduction in low-temperature toughness is caused. Therefore, the W content is preferably limited to a range from 0.001% to 0.150% and is more preferably 0.04% or less.

Cr: 0.001% to 0.45%

Cr has a function of preventing the strength of the tube that is formed into cross-sectional shape and is then stress-relief annealed from being reduced due to Mn, a function of preventing the initiation of fatigue cracks, and a function of assisting in enhancing torsional fatigue endurance as described above. To achieve such effects, the content of Cr is preferably 0.001% or more. When the Cr content is greater than 0.45%, a reduction in formability is caused. Therefore, the Cr content is preferably limited to a range from 0.001% to 0.45% and is more preferably 0.29% or less.

Mo: 0.001% to 0.24%

Mo, as well as Cr, has a function of preventing the strength of the tube that is formed into cross-sectional shape and is then stress-relief annealed from being reduced due to Mn, a function of preventing the initiation of fatigue cracks, and a function of assisting in enhancing torsional fatigue endurance.

To achieve such effects, the content of Mo is preferably 0.001% or more. When the Mo content is greater than 0.24%, a reduction in formability is caused. Therefore, the Mo content is preferably limited to a range from 0.001% to 0.24% and more preferably 0.045% to 0.14%.

B: 0.001% to 0.0009%

B, as well as Cr, has a function of preventing the strength of the tube that is formed into cross-sectional shape and is then stress-relief annealed from being reduced due to Mn, a function of preventing the initiation of fatigue cracks, and a function of assisting in enhancing torsional fatigue endurance.

To achieve such effects, the content of B is preferably 0.0001% or more. When the B content is greater than 0.0009%, a reduction in formability is caused. Therefore, the B content is preferably limited to a range from 0.0001% to 0.0009% and is more preferably 0.0005% or less.

Cu: 0.001% to 0.45%

Cu has a function of preventing the strength of the tube that is formed into cross-sectional shape and is then stress-relief annealed from being reduced due to Mn, a function of preventing the initiation of fatigue cracks, a function of assisting in enhancing torsional fatigue endurance, and a function of enhancing corrosion resistance. To achieve such effects, the content of Cu is preferably 0.001% or more. When the Cu content is greater than 0.45%, a reduction in formability is caused. Therefore, the Cu content is preferably limited to a range from 0.001% to 0.45% and is more preferably 0.20% or less.

Ni: 0.001% to 0.45%

Ni, as well as Cu, has a function of preventing the strength of the tube that is formed into cross-sectional shape and is then stress-relief annealed from being reduced due to Mn, a function of preventing the initiation of fatigue cracks, a function of assisting in enhancing torsional fatigue endurance, and a function of enhancing corrosion resistance. To achieve such effects, the content of Ni is preferably 0.001% or more. When the Ni content is greater than 0.45%, a reduction in formability is caused. Therefore, the Ni content is preferably limited to a range from 0.001% to 0.45% and is more preferably 0.2% or less.

Ca: 0.0001% to 0.005%

Ca has a function of transforming an elongated inclusion (MnS) into a granular inclusion (Ca(Al)S(O)), that is, a so-called function of controlling the morphology of an inclusion. Ca also has a function of enhancing formability and torsional fatigue endurance because of the morphology control of such an inclusion. Such an effect is remarkable when the content of Ca is 0.0001% or more. When the Ca content is greater than 0.005%, a reduction in torsional fatigue endurance is caused due to an increase in the amount of a non-metal inclusion. Therefore, the Ca content is preferably limited to a range from 0.0001% to 0.005% and more preferably 0.0005% to 0.0025%.

The reminder other than the above components is Fe and unavoidable impurities.

Reasons for limiting the microstructure of the high-tensile strength welded steel tube will now be described.

The microstructure of the high-tensile strength welded steel tube (hereinafter also referred to as "steel tube") is a material factor that is important in allowing the tube that is stress-relief annealed to have excellent formability and excellent torsional fatigue endurance.

The steel tube has a microstructure containing a ferrite phase and a second phase other than the ferrite phase. The term "ferrite phase" used herein covers polygonal ferrite, acicular ferrite, Widmanstatten ferrite, and bainitic ferrite. The second phase other than the ferrite phase is preferably one of carbide, pearlite, bainite, and martensite or a mixture of some of these phases.

The ferrite phase has an average grain size of 2 μm to 8 μm in circumferential cross section (in cross section perpendicular to the longitudinal direction of the tube) and a microstructure fraction of 60 volume percent or more. The ferrite phase contains a precipitate of a (Nb, Ti) composite carbide having an average grain size of 2 nm to 40 nm.

Microstructure Fraction of Ferrite Phase: 60 Volume Percent or More

When the microstructure fraction of the ferrite phase is less than 60 volume percent, the tube that is stress-relief annealed cannot have desired formability and have significantly low torsional fatigue endurance because locally wasted portions, surface irregularities, and the like caused during forming act as stress-concentrated portions. Therefore, in the steel tube, the microstructure fraction of the ferrite phase is limited to 60 volume percent or more and is preferably 75 volume percent or more.

Average Grain Size of Ferrite Phase: 2 μm to 8 μm

When the average grain size of the ferrite phase is less than 2 μm, the tube that is stress-relief annealed cannot have desired formability and have significantly low torsional fatigue endurance because locally wasted portions, surface irregularities, and the like caused during forming act as stress-concentrated portions. When the average grain size of ferrite phase is greater than 8 μm and therefore is coarse, the tube that is stress-relief annealed has low low-temperature toughness and low torsional fatigue endurance. Therefore, in the steel tube, the average grain size of the ferrite phase is limited to a range from 2 μm to 8 μm and is preferably 6.5 μm or less.

Average Grain Size of (Nb, Ti) Composite Carbide in Ferrite Phase: 2 nm to 40 nm The (Nb, Ti) composite carbide in the ferrite phase is a microstructural factor that is important in allowing the tube that is stress-relief annealed to have a good balance between a rate of change in cross-sectional hardness and a rate of reduction in residual stress, high torsional fatigue endurance, and desired formability. When the average grain size of the (Nb, Ti) composite carbide is less than 2 nm, the steel tube has an elongation El of less than 15% and reduced formability, the rate of change in cross-sectional hardness of the steel tube that is formed into cross-sectional shape and then stress-relief annealed is less than a predetermined value (−15%), the rate of reduction in residual stress of the steel tube is less than a predetermined value (50%), and the steel tube that is stress-relief annealed has reduced torsional fatigue endurance. Meanwhile, when the average grain size of the (Nb, Ti) composite carbide is greater than 40 nm and therefore is coarse, the rate of change in cross-sectional hardness of the steel tube that is formed into cross-sectional shape and then stress-relief annealed is less than a predetermined value (−15%) and the steel tube that is stress-relief annealed has reduced torsional fatigue endurance. Therefore, the average grain size of the (Nb, Ti) composite carbide in the ferrite phase is limited to a range from 2 nm to 40 nm and is preferably 3 nm to 30 nm.

Figure 2:
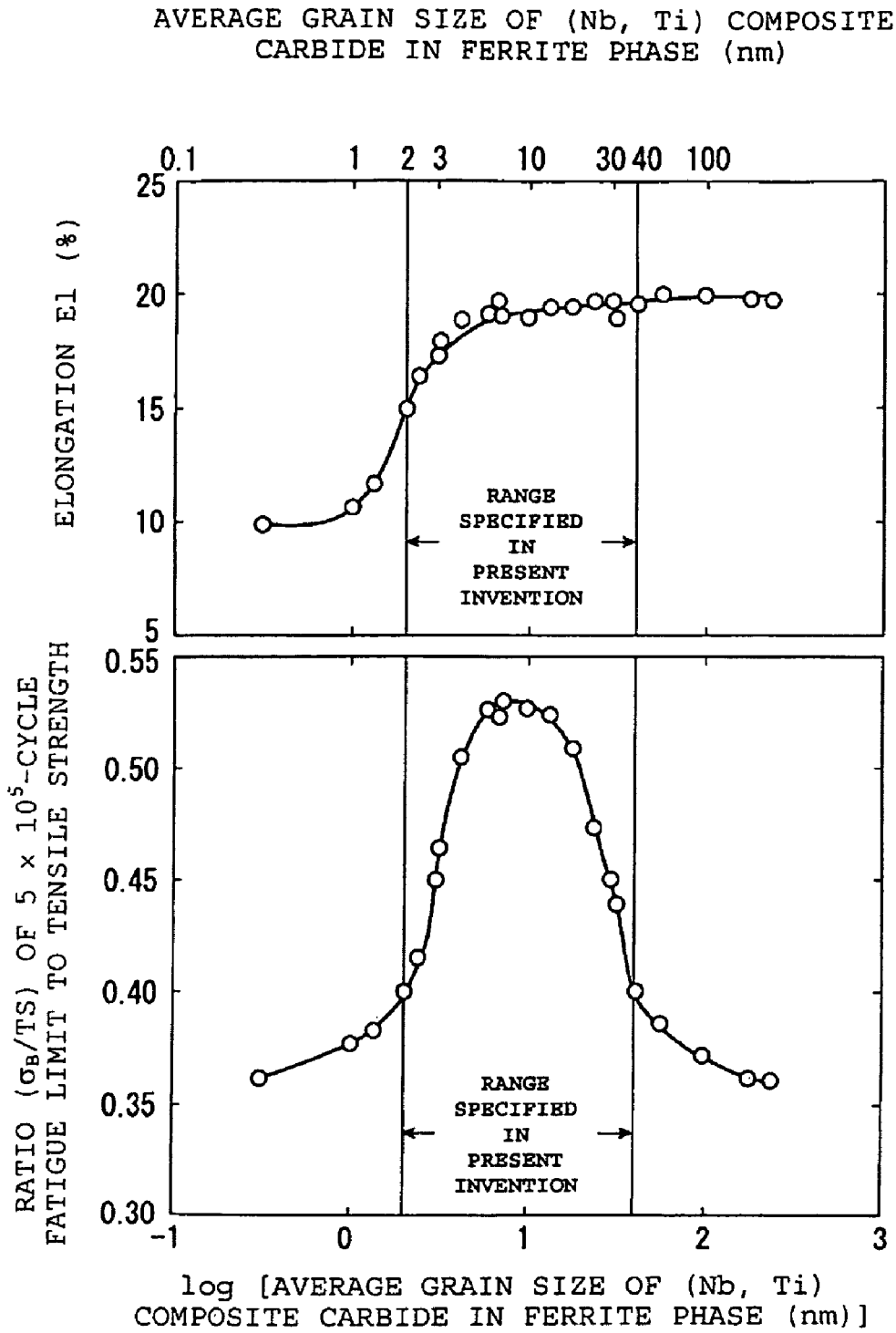
FIG. 2 is a graph showing the relationship between the average grain size of a (Nb, Ti) composite carbide in each ferrite phase, the ratio ($\sigma_B$/TS) of the $5\times10^5$-cycle fatigue limit $\sigma_B$ to the tensile strength TS of each steel tube that is stress-relief annealed, and the elongation El of a JIS #12 test specimen taken from the steel tube.

FIG. 1 shows the relationship between the average grain size of a (Nb, Ti) composite carbide in each ferrite phase, the rate of change in cross-sectional hardness of each steel tube that is formed into cross-sectional shape and then stress-relief annealed, and the rate of reduction in residual stress of the steel tube. FIG. 2 shows the relationship between the average grain size of a (Nb, Ti) composite carbide in each ferrite phase, the elongation El of each steel tube (JIS #12 test specimen) that has not yet been formed into cross-sectional shape, and the ratio ($\sigma_B$/TS) of the $5\times10^5$-cycle fatigue limit $\sigma_B$ to the tensile strength TS of the steel tube.

The rate (%) of change in cross-sectional hardness of the steel tube that is formed into cross-sectional shape and then stress-relief annealed (SR) is defined by the following equation:

rate of change in cross-sectional hardness={(cross-sectional hardness after SR)−(cross-sectional hardness before SR)}/(cross-sectional hardness before SR)×(100%).

The rate (%) of reduction in residual stress of the steel tube that is formed into cross-sectional shape and then stress-relief annealed is defined by the following equation:

rate (%) reduction in residual stress={(residual stress before SR)−(residual stress after SR)}/(residual stress after SR)×(100%).

Figure 3:
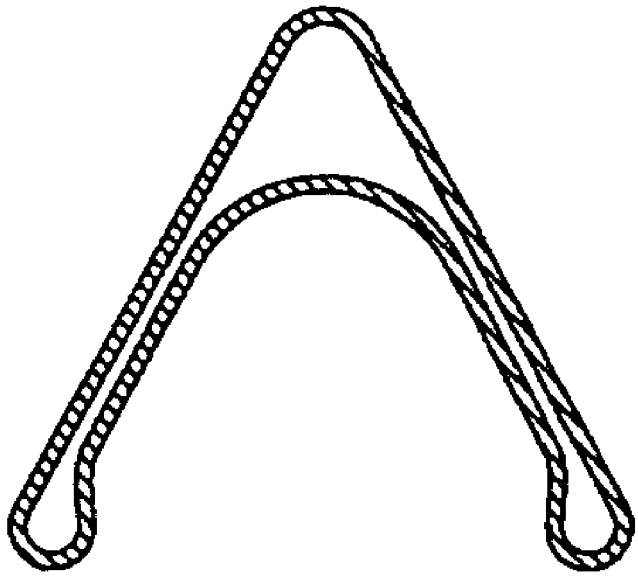
FIG. 3 is an illustration of a test material which is formed into cross-sectional shape and which is used for a torsional fatigue test.

The torsional fatigue endurance of the steel tube that is stress-relief annealed is evaluated from the ratio ($\sigma_B$/Ts) of the $5\times10^5$-cycle fatigue limit to the tensile strength TS of the steel tube. The $5\times10^5$-cycle fatigue limit of the steel tube is determined in such a manner that a longitudinally central portion of the steel tube is formed so as to have a V-shape in cross section as shown in FIG. 3 (FIG. 11 of Japanese Unexamined Patent Application Publication No. 2001-321846), the resulting steel tube is stress-relief annealed at 530° C. for ten minutes, both end portions of the steel tube are fixed by chucking, and the steel tube is subjected to a torsional fatigue test under completely reversed torsion at 1 Hz for $5\times10^5$ cycles.

As is clear from the relationship, shown in FIG. 1, between the average grain size of a (Nb, Ti) composite carbide in each ferrite phase, the rate of change in cross-sectional hardness, and the rate of reduction in residual stress, a steel tube containing a ferrite phase containing a (Nb, Ti) composite carbide with an average grain size outside the range of 2 nm to 40 nm has a rate of change in cross-sectional hardness of less than −15% or a rate of reduction in residual stress of less than 50%. As is clear from the relationship, shown in FIG. 2, between the average grain size of a (Nb, Ti) composite carbide in each ferrite phase, the elongation El of each steel tube, and the ratio ($\sigma_B$/TS), a steel tube containing a ferrite phase containing a (Nb, Ti) composite carbide with an average grain size outside the range of 2 nm to 40 nm has a $\sigma_B$/Ts ratio of less than 0.40 or an elongation El of less than 15%. These show that such a steel tube containing a ferrite phase containing a (Nb, Ti) composite carbide with an average grain size outside the range of 2 nm to 40 nm cannot have excellent formability or excellent torsional fatigue endurance after being stress-relief annealed.

The average grain size of a (Nb, Ti) composite carbide in a ferrite phase is determined as described below. A sample for microstructure observation is taken from a steel tube by an extraction replica method. Five fields of view of the sample are observed with a transmission electron microscope (TEM) at a magnification of 100000 times. Cementite, which contains no Nb or Ti, TiN, and the like are identified by EDS analysis and then eliminated. For carbides ((Nb, Ti) composite carbides) containing Nb and/or Ti, the area of each grain of a (Nb, Ti) composite carbide is measured with an image analysis device and the equivalent circle diameter of the grain is calculated from the area thereof. The equivalent circle diameters of the grains are arithmetically averaged, whereby the average grain size of the (Nb, Ti) composite carbide is obtained. Carbides containing Nb, Ti, Mo, and/or the like are counted as the (Nb, Ti) composite carbide.

The steel tube preferably has surface properties below. That is, the inner and outer surfaces of the steel tube preferably have an arithmetic average roughness Ra of 2 μm or less, a maximum-height roughness Rz of 30 μm or less, and a ten-point average roughness $Rz_{JIS}$ of 20 μm or less as determined in accordance with JIS B 0601-2001. When the steel tube does not satisfy the above surface properties, the steel tube has reduced formability and reduced torsional fatigue endurance because stress-concentrated portions are formed in the steel tube during processing such as forming into cross-sectional shape.

A method of producing the steel tube will now be described.

Steel having the above composition is preferably produced by a known process using a steel converter or the like and then cast into a steel material by a known process such as a continuous casting process.

The steel material is preferably subjected to a hot-rolling step such that a steel tube material such as a hot-rolled steel strip is obtained.

The hot-rolling step preferably includes a hot-rolling sub-step of heating the steel material to a temperature of 1160° C. to 1320° C. and finish-rolling the resulting steel material into the hot-rolled steel strip at a temperature of 760° C. to 980° C., a slow cooling sub-step of slow cooling the hot-rolled steel strip at a temperature of 650° C. to 750° C. for 2 s or more, and a coiling sub-step of coiling the resulting hot-rolled steel strip at a temperature of 510° C. to 660° C.

Heating Temperature of Steel Material: 1160° C. to 1320° C.

The heating temperature of the steel material affects the rate of change in cross-sectional hardness of the steel tube that is stress-relief annealed depending on the solution or precipitation of Nb and Ti in steel and therefore is a factor that is important in preventing the softening thereof. When the heating temperature thereof is lower than 1160° C., the rate of change in cross-sectional hardness of the steel tube that is stress-relief annealed (530° C.×10 min) is less than −15% and therefore desired torsional fatigue endurance cannot be achieved because coarse precipitates of niobium carbonitride and titanium carbonitride that are formed during continuous casting remain in the steel material without forming solid solutions and therefore coarse grains of a (Nb, Ti) composite carbide are formed in a ferrite phase obtained in a hot-rolled steel sheet. Meanwhile, when the heating temperature thereof is higher than 1320° C., the formability of the steel tube is low and the low-temperature toughness and torsional fatigue endurance of the steel tube that is stress-relief annealed are low because coarse crystal grains are formed and therefore a ferrite phase obtained in the hot rolling sub-step becomes coarse. Therefore, the heating temperature of the steel material is preferably limited to a range from 1160° C. to 1320° C. and more preferably 1200° C. to 1300° C. To secure the uniformity of solid solutions of Nb and Ti and a sufficient solution time, the soaking time of the heated steel material is preferably 30 minutes or more.

Finish-rolling Final Temperature: 760° C. to 980° C.

The finish-rolling final temperature of the steel material rolled in the hot-rolling sub-step is a factor that is important in adjusting the microstructure fraction of a ferrite phase in the steel tube material to a predetermined range and to adjust the average grain size of the ferrite phase to a predetermined range to allow the steel tube to have good formability. When the finish-rolling final temperature thereof is higher than 980° C., the following problems arise: the steel tube has reduced formability because the ferrite phase of the steel tube material has an average grain size of greater than 8 μm and a microstructure fraction of less than 60 volume percent; the inner and outer surfaces of the steel tube have an arithmetic average roughness Ra of greater than 2 μm, a maximum-height roughness Rz of greater than 30 μm, and a ten-point average roughness $Rz_{JIS}$ of greater than 20 μm; and the steel tube has undesired surface properties and reduced torsional fatigue endurance. Meanwhile, when the finish-rolling final temperature thereof is lower than 760° C., the following problems arise: the steel tube has reduced formability because the ferrite phase of the steel tube material has an average grain size of less than 2 μm; the (Nb, Ti) composite carbide has an average grain size of greater than 40 nm because of strain-induced precipitation; the rate of change in cross-sectional hardness of the steel tube that is stress-relief annealed (530° C.×10 min) is less than −15%; and the steel tube cannot have desired torsional fatigue endurance. Therefore, the finish-rolling final temperature thereof is preferably limited to a range from 760° C. to 980° C. and more preferably 820° C. to 880° C. To allow the steel tube to have good surface properties, the steel tube material is preferably descaled with high-pressure water at 9.8 MPa (100 Kg/cm$^2$) or more in advance of finish rolling.

Slow Cooling: at a Temperature of 650° C. to 750° C. for 2 s or More

The hot-rolled steel strip is not coiled directly after finish rolling is finished but is slow cooled at a temperature of 650° C. to 750° C. in advance of coiling. The term "slow cooling" used herein means cooling at a rate of 20° C./s or less. The slow cooling time of the steel strip, which is slow cooled at the above temperature, is preferable 2 s or more and more preferably 4 s or more. The slow cooling thereof allows the microstructure fraction of the ferrite phase to be 60 volume percent or more, allows the elongation El of the steel tube to be 15% or more as determined using a JIS #12 test specimen, and allows the steel tube to have desired formability.

Coiling Temperature: 510° C. to 660° C.

The slow cooled hot-rolled steel strip is coiled into a coil. The coiling temperature thereof is preferably within a range from 510° C. to 660° C. The coiling temperature thereof is a factor that is important in determining the microstructure fraction of the ferrite phase of the hot-rolled steel strip and/or the precipitation of the (Nb, Ti) composite carbide. When the coiling temperature thereof is lower than 510° C., the ferrite phase cannot have a desired microstructure fraction and therefore the steel tube cannot have desired formability. Furthermore, the (Nb, Ti) composite carbide has an average grain size of less than 2 nm and the strength of the steel tube is significantly reduced during stress-relief annealing; hence, the steel tube cannot have desired torsional fatigue endurance.

Meanwhile, when the coiling temperature thereof is higher than 660° C., the following problems arise: the steel tube has reduced formability because the ferrite phase has an average grain size of greater than 8 μm; a large amount of scales are formed after coiling; the steel strip has undesired surface properties; the inner and outer surfaces of the steel tube have an arithmetic average roughness Ra of greater than 2 μm; a maximum-height roughness Rz of greater than 30 μm, and a ten-point average roughness $Rz_{JIS}$ of greater than 20 μm; and the steel tube has undesired surface properties and reduced torsional fatigue endurance. Furthermore, the (Nb, Ti) composite carbide becomes coarse because of Ostwald growth and therefore have an average grain size of greater than 40 nm, the rate of change in cross-sectional hardness of the steel tube that is stress-relief annealed (530° C.×10 min) is less than −15%, and the steel tube cannot have desired torsional fatigue endurance. Therefore, the coiling temperature thereof is preferably limited to a range from 510° C. to 660° C. and more preferably 560° C. to 620° C.

Since the steel material, which has the above composition, is subjected to the hot-rolling step under the above conditions, the microstructure and the condition of precipitates are optimized and therefore the steel tube material (hot-rolled steel strip) has excellent surface properties and excellent formability. Furthermore, the steel tube, which is produced from the steel tube material and then stress-relief annealed (530° C.×10 min), has a small rate of change in cross-sectional hardness and desired excellent torsional fatigue endurance.

The steel tube material (hot-rolled steel strip) is subjected to an electrically welded tube-making step, whereby a welded steel tube is obtained. A preferred example of the electrically welded tube-making step is described below.

The steel tube material may be used directly after hot rolling and is preferably pickled or shot-blasted such that scales are removed from the steel tube material. In view of corrosion resistance and coating adhesion, the steel tube material may be subjected to surface treatment such as zinc plating, aluminum plating, nickel plating, or organic coating treatment.

The steel tube material that is pickled and/or is then surface-treated is subjected to the electrically welded tube-making step. The electrically welded tube-making step includes a sub-step of continuously roll-forming the steel tube material and electrically welding the resulting steel tube material into an electrically welded steel tube. In the electrically welded tube-making step, the electrically welded steel tube is preferably made at a width reduction of 10% or less (including 0%). The width reduction is a factor that is important in achieving desired formability. When the width reduction is greater than 10%, a reduction in formability during tube making is remarkable and therefore desired formability cannot be achieved. Therefore, the width reduction is preferably 10% or less (including 0%) and more preferably 1% or more. The width reduction (%) is defined by the following equation:

$$\text{width reduction (\%)}=[(\text{width of steel tube material})-\pi\{(\text{outer diameter of product})-(\text{thickness of product})\}]/\pi\{(\text{outer diameter of product})-(\text{thickness of product})\}\times(100\%) \quad (1).$$

The steel tube material is not limited to the hot-rolled steel strip. There is no problem if the following strip is used instead of the hot-rolled steel strip: a cold-rolled annealed steel strip made by cold-rolling and then annealing the steel material, which has the above composition and microstructure, or a surface-treated steel strip: made by surface-treating the cold-rolled annealed steel strip. The following step may be used instead of the electrically welded tube-making step: a tube-making step including roll forming; closing a cross section of a cut sheet by pressing; stretch-reducing a tube under cold, warm, or hot conditions; heat treatment; and the like. There is no problem if laser welding, arc welding, or plasma welding is used instead of electric welding.

The high-tensile strength welded steel tube is formed into various shapes and then stress-relief annealed as required, whereby an automobile structural part such as a torsion beam is produced. In the high-tensile strength welded steel tube, conditions of stress-relief annealing subsequent to forming need not be particularly limited. The fatigue life of the tube is remarkably enhanced by stress-relief annealing the tube at a temperature of about 100° C. to lower than about 650° C. because the diffusion of C prevents the motion of dislocations at about 100° C. and the hardness of the tube is remarkably reduced by annealing the tube at about 650° C. Therefore, a 150-200° C. coating baking step may be used instead of a stress-relief annealing step. In particular, the effect of enhancing fatigue life is optimized at a temperature of 460° C. to 590° C. The soaking time during stress-relief annealing is preferably within a range from 1 s to 5 h and more preferably 2 min to 1 h.

EXAMPLES

Example 1

Steels having compositions shown in Table 1 were produced and then cast into steel materials (slabs) by a continuous casting process. Each steel material was subjected to a hot-rolling step in such a manner that the steel material was heated to about 1250° C., hot-rolled at a finish-rolling temperature of about 860° C., slow cooled at a temperature 650° C. to 750° C. for 5 s, and then coiled at a temperature of 590° C., whereby a hot-rolled steel strip (a thickness of about 3 mm) was obtained.

The hot-rolled steel strip was used as a steel tube material. The hot-rolled steel strip was pickled and then slit into pieces having a predetermined width. The pieces were continuously roll-formed into open tubes. Each open tube was subjected to an electrically welded tube-making step in which the open tube was electrically welded by high-frequency resistance welding, whereby a welded steel tube (an outer diameter ϕ of 89.1 mm and a thickness of about 3 mm) was prepared.

In the electrically welded tube-making step, the width reduction defined by Equation (1) was 4%.

Test specimens were taken from the welded steel tubes and then subjected to a microstructure observation test, a precipitate observation test, a tensile test, a surface roughness test, a torsional fatigue test, a low-temperature toughness test, a cross-sectional hardness measurement test subsequent to stress-relief annealing, and a residual stress measurement test subsequent to stress-relief annealing. These tests were as described below.

(1) Microstructure Observation Test

A test specimen for microstructure observation was taken from each of the obtained welded steel tubes such that a circumferential cross section of the test specimen could be observed. The test specimen was polished, corroded with nital, and then observed for microstructure with a scanning electron microscope (3000 times magnification). An image of the test specimen was taken and then used to determine the volume percentage and average grain size (equivalent circle diameter) of a ferrite phase with an image analysis device.

(2) Precipitate Observation Test

A test specimen for precipitate observation was taken from each of the obtained welded steel tubes such that a circumferential cross section of the test specimen could be observed.

A sample for microstructure observation was prepared from the test specimen by an extraction replica method. Five fields of view of the sample were observed with a transmission electron microscope (TEM) at a magnification of 100000 times. Cementite, which contained no Nb or Ti, TiN, and the like were identified by EDS analysis and then eliminated. For carbides ((Nb, Ti) composite carbides) containing Nb and/or Ti, the area of each grain of a (Nb, Ti) composite carbide was measured with an image analysis device and the equivalent circle diameter of the grain was calculated from the area thereof. The equivalent circle diameters of the grains were arithmetically averaged, whereby the average grain size of the (Nb, Ti) composite carbide was obtained. Carbides containing Nb, Ti, Mo, and/or the like were counted as the (Nb, Ti) composite carbide.

(3) Tensile Test

A JIS #12 test specimen was cut out from each of the obtained welded steel tubes in accordance with JIS Z 2201 such that an L-direction was a tensile direction. The specimen was subjected to a tensile test in accordance with JIS Z 2241, measured for tensile properties (tensile strength TS, yield strength YS, and elongation El), and then evaluated for strength and formability.

(4) Surface Roughness Test

The inner and outer surfaces of each of the obtained welded steel tubes were measured for surface roughness with a probe-type roughness meter in accordance with JIS B 0601-2001, whereby a roughness curve was obtained and roughness parameters, that is, the arithmetic average roughness Ra, maximum-height roughness Rz, and ten-point average roughness $Rz_{JIS}$ of each tube were determined. The roughness curve was obtained in such a manner that the tube was measured in the circumferential direction (C-direction) of the tube and a low cutoff value of 0.8 mm and an evaluation length of 4 mm were used. A larger one of parameters of the inner and outer surfaces thereof was used as a typical value.

(5) Torsional Fatigue Test

A test material (a length of 1500 mm) was taken from each of the obtained welded steel tubes. A longitudinally central portion of the steel tube was formed so as to have a V-shape in cross section as shown in FIG. 3 (FIG. 11 of Japanese Unexamined Patent Application Publication No. 2001-321846) and then stress-relief annealed at 530° C. for ten minutes. The test material was subjected to a torsional fatigue in such a manner that both end portions thereof were fixed by chucking.

The torsional fatigue test was performed under completely reversed torsion at 1 Hz, the level of a stress was varied, and the number N of cycles performed until breakage occurred at a load stress S was determined. The $5\times10^5$-cycle fatigue limit $\sigma_B$ (MPa) of the test material was determined from an S-N diagram obtained by the test. The torsional fatigue endurance of the test material was evaluated from the ratio $\sigma_B$/Ts (wherein TS represents the tensile stress (MPa) of the steel tube). The load stress was measured in such a manner that a dummy piece was first subjected to a torsion test, the location of a fatigue crack was thereby identified, and a triaxial strain gauge was then attached to the location thereof.

(6) Low-temperature Toughness Test

Test materials (a length of 1500 mm) were taken from each of the obtained welded steel tubes. The test materials were formed into cross-sectional shape and stress-relief annealed under the same conditions as those used to treat the test material for the torsional fatigue test. A flat portion of one of the unannealed test materials was expanded such that the circumferential direction (C-direction) of a corresponding one of the tubes corresponds to the length direction of this test material. A flat portion of one of the stress-relief annealed test materials was expanded such that the circumferential direction (C-direction) of a corresponding one of the tubes corresponds to the length direction of this test material. A V-notched test specimen (¼-sized) was cut out from each of the flat portions in accordance with JIS Z 2242, subjected to a Charpy impact test, and then measured for fracture appearance transition temperature vTrs, whereby the specimen was evaluated for low-temperature toughness.

(7) Cross-sectional Hardness Measurement Test Subsequent to Stress-relief Annealing Test materials were formed into cross-sectional shape under the same conditions as those used to treat the test material for the torsional fatigue test. Some of the test materials were stress-relief annealed (530° C.×10 min). Test specimens for cross-sectional hardness measurement were taken from fatigue crack-corresponding portions of the unannealed test materials and those of the annealed test materials and then measured for Vickers hardness with a Vickers hardness meter (a load of 10 kg). Three portions of each test material that were each located at a depth equal to ¼, ½, or ¾ of the thickness thereof were measured for thickness and obtained measurements were averaged, whereby the cross-sectional hardness of the test material subjected or unsubjected to stress-relief annealing (SR) was obtained. The rate of change in cross-sectional hardness of the test material subjected to stress-relief annealing (SR) was determined from the following equation and used as a parameter indicating the softening resistance of the test material subjected to stress-relief annealing (SR):

Rate of change in cross-sectional hardness={(cross-sectional hardness after SR)−(cross-sectional hardness before SR)}/(cross-sectional hardness before SR)×(100%).

(8) Residual Stress Measurement Test Subsequent to Stress-relief Annealing

Test materials were formed into cross-sectional shape under the same conditions as those used to treat the test material for the torsional fatigue test. Some of the test materials were stress-relief (SR) annealed (530° C.×10 min). Fatigue crack-corresponding portions of the unannealed test materials and those of the annealed test materials were measured for residual stress by a cutting-off method with strain gauge using a triaxial gauge. The rate (%) of reduction in residual stress of each test material subjected to stress-relief annealing was determined from the following equation:

Rate (%) reduction in residual stress={(residual stress before SR)−(residual stress after SR)}/(residual stress after SR)×(100%).

Obtained results are shown in Table 2.

TABLE 1

| Steel | Chemical components (mass percent) | | | | | | | | | | | | |
|---|---|---|---|---|---|---|---|---|---|---|---|---|---|
| No. | C | Si | Mn | Al | Ti | Nb | Ti + Nb | P | S | N | O | Others | Remarks |
| A | 0.087 | 0.22 | 1.56 | 0.035 | 0.056 | 0.036 | 0.092 | 0.010 | 0.004 | 0.0037 | 0.0014 | — | Example |
| B | 0.092 | 0.22 | 1.72 | 0.033 | 0.049 | 0.043 | 0.092 | 0.009 | 0.002 | 0.0049 | 0.0016 | Ca: 0.0022 | Example |

TABLE 1-continued

| Steel No. | Chemical components (mass percent) C | Si | Mn | Al | Ti | Nb | Ti + Nb | P | S | N | O | Others | Remarks |
|---|---|---|---|---|---|---|---|---|---|---|---|---|---|
| C | 0.095 | 0.26 | 1.66 | 0.032 | 0.068 | 0.036 | 0.104 | 0.008 | 0.001 | 0.0033 | 0.0012 | Cr: 0.12, Mo: 0.11, Ca: 0.0021 | Example |
| D | 0.068 | 0.35 | 1.31 | 0.040 | 0.052 | 0.033 | 0.085 | 0.005 | 0.0006 | 0.0015 | 0.0018 | V: 0.015 | Example |
| E | 0.157 | 0.01 | 1.88 | 0.014 | 0.095 | 0.018 | 0.113 | 0.014 | 0.0005 | 0.0066 | 0.0033 | W: 0.023 | Example |
| F | 0.039 | 0.42 | 1.62 | 0.054 | 0.043 | 0.041 | 0.084 | 0.018 | 0.002 | 0.0042 | 0.0015 | Cr: 0.062 | Example |
| G | 0.212 | 0.76 | 1.03 | 0.072 | 0.071 | 0.025 | 0.096 | 0.002 | 0.013 | 0.0076 | 0.0032 | Mo: 0.11 | Example |
| H | 0.107 | 0.22 | 1.53 | 0.042 | 0.058 | 0.035 | 0.093 | 0.012 | 0.002 | 0.0026 | 0.0011 | B: 0.0002 | Example |
| I | 0.059 | 0.43 | 1.47 | 0.032 | 0.066 | 0.044 | 0.110 | 0.018 | 0.001 | 0.0032 | 0.0008 | Cu: 0.11, Ni: 0.02 | Example |
| J | 0.073 | 0.19 | 1.46 | 0.022 | 0.072 | 0.039 | 0.111 | 0.009 | 0.002 | 0.0029 | 0.0007 | V: 0.011, Cr: 0.07, Mo: 0.14, Cu: 0.03, Ni: 0.05, Ca: 0.0008 | Example |
| K | 0.024 | 0.27 | 1.44 | 0.063 | 0.056 | 0.032 | 0.088 | 0.014 | 0.008 | 0.0014 | 0.0018 | — | Comparative Example |
| L | 0.252 | 0.16 | 1.74 | 0.026 | 0.065 | 0.039 | 0.104 | 0.011 | 0.0008 | 0.0031 | 0.0012 | — | Comparative Example |
| M | 0.125 | 0.001 | 1.52 | 0.074 | 0.066 | 0.041 | 0.107 | 0.016 | 0.002 | 0.0030 | 0.0012 | — | Comparative Example |
| N | 0.059 | 0.98 | 1.58 | 0.038 | 0.074 | 0.033 | 0.107 | 0.005 | 0.002 | 0.0036 | 0.0044 | — | Comparative Example |
| O | 0.098 | 0.44 | 0.96 | 0.049 | 0.065 | 0.037 | 0.102 | 0.017 | 0.005 | 0.018 | 0.0007 | — | Comparative Example |

TABLE 2

| Steel No. | Chemical components (mass percent) C | Si | Mn | Al | Ti | Nb | Ti + Nb | P | S | N | O | Others | Remarks |
|---|---|---|---|---|---|---|---|---|---|---|---|---|---|
| P | 0.116 | 0.35 | 2.06 | 0.021 | 0.066 | 0.041 | 0.107 | 0.012 | 0.003 | 0.0033 | 0.0015 | — | Comparative Example |
| Q | 0.081 | 0.26 | 1.28 | 0.007 | 0.054 | 0.032 | 0.086 | 0.019 | 0.006 | 0.0032 | 0.0011 | — | Comparative Example |
| R | 0.108 | 0.19 | 1.44 | 0.120 | 0.056 | 0.035 | 0.091 | 0.012 | 0.002 | 0.0039 | 0.0022 | — | Comparative Example |
| S | 0.076 | 0.44 | 1.35 | 0.024 | 0.032 | 0.048 | 0.080 | 0.018 | 0.0009 | 0.0019 | 0.0006 | — | Comparative Example |
| T | 0.089 | 0.20 | 1.53 | 0.042 | 0.162 | 0.044 | 0.206 | 0.009 | 0.003 | 0.0039 | 0.0024 | — | Comparative Example |
| U | 0.111 | 0.41 | 1.49 | 0.035 | 0.066 | 0.015 | 0.081 | 0.014 | 0.002 | 0.0045 | 0.0011 | — | Comparative Example |
| V | 0.088 | 0.12 | 1.36 | 0.026 | 0.061 | 0.163 | 0.224 | 0.010 | 0.004 | 0.0024 | 0.0020 | — | Comparative Example |
| W | 0.135 | 0.39 | 1.75 | 0.025 | 0.062 | 0.039 | 0.101 | 0.026 | 0.002 | 0.0048 | 0.0005 | — | Comparative Example |
| X | 0.092 | 0.14 | 1.73 | 0.054 | 0.074 | 0.031 | 0.105 | 0.015 | 0.023 | 0.0034 | 0.0016 | — | Comparative Example |
| Y | 0.123 | 0.14 | 1.44 | 0.029 | 0.072 | 0.042 | 0.114 | 0.006 | 0.0004 | 0.0124 | 0.0014 | — | Comparative Example |
| Z | 0.096 | 0.35 | 1.63 | 0.044 | 0.068 | 0.031 | 0.100 | 0.013 | 0.002 | 0.0028 | 0.0064 | — | Comparative Example |
| AA | 0.069 | 0.25 | 1.28 | 0.033 | 0.065 | 0.042 | 0.105 | 0.016 | 0.006 | 0.0041 | 0.0010 | V: 0.172 | Comparative Example |
| AB | 0.097 | 0.13 | 1.53 | 0.058 | 0.060 | 0.032 | 0.092 | 0.014 | 0.003 | 0.0034 | 0.0013 | Cr: 0.52 | Comparative Example |
| AC | 0.074 | 0.36 | 1.71 | 0.039 | 0.059 | 0.047 | 0.106 | 0.010 | 0.004 | 0.0035 | 0.0010 | Mo: 0.32 | Comparative Example |
| AD | 0.121 | 0.24 | 1.35 | 0.034 | 0.062 | 0.041 | 0.103 | 0.008 | 0.002 | 0.0038 | 0.0008 | B: 0.0012 | Comparative Example |
| AE | 0.095 | 0.32 | 1.44 | 0.022 | 0.063 | 0.042 | 0.105 | 0.013 | 0.003 | 0.0027 | 0.0033 | Cu: 0.49 | Comparative Example |

TABLE 3

| Steel Tube No. | Steel No. | Microstructure: Ferrite fraction (%) | Average grain size of ferrite (μm) | Average grain size of (Nb, Ti) composite carbide in ferrite phase (nm) | Tensile properties: TS (MPa) | YS (MPa) | EI [JIS #12 test specimen] (%) | Rate of change in cross-sectional hardness after forming into cross-sectional shape and SR annealing (%) | Rate of reduction in residual stress after forming into cross-sectional shape and SR annealing (%) |
|---|---|---|---|---|---|---|---|---|---|
| 1 | A | 86 | 4.0 | 4 | 802 | 745 | 18 | 1 | 68 |
| 2 | B | 84 | 3.0 | 4 | 826 | 710 | 18 | 2 | 63 |
| 3 | C | 87 | 2.6 | 6 | 832 | 728 | 18 | 4 | 70 |
| 4 | D | 89 | 3.2 | 7 | 781 | 688 | 18 | −2 | 66 |
| 5 | E | 61 | 3.0 | 9 | 980 | 846 | 15 | −14 | 51 |
| 6 | F | 92 | 3.9 | 8 | 761 | 664 | 20 | −8 | 60 |
| 7 | G | 61 | 5.6 | 19 | 940 | 827 | 18 | −14 | 52 |
| 8 | H | 80 | 3.1 | 8 | 902 | 746 | 18 | −8 | 60 |
| 9 | I | 90 | 2.2 | 6 | 757 | 689 | 19 | −7 | 62 |
| 10 | J | 86 | 2.6 | 4 | 852 | 767 | 16 | 0 | 64 |
| 11 | K | 96 | 8.6 | 10 | 579 | 491 | 24 | −21 | 56 |
| 12 | L | 55 | 2.3 | 14 | 1021 | 896 | 13 | −17 | 44 |
| 13 | M | 48 | 3.7 | 56 | 1006 | 902 | 12 | −18 | 46 |
| 14 | N | 90 | 6.3 | 9 | 866 | 753 | 14 | −12 | 44 |
| 15 | O | 88 | 8.8 | 22 | 634 | 553 | 20 | −22 | 55 |

TABLE 3-continued

| Steel Tube No. | Torsional fatigue endurance after forming into cross-sectional shape and SR annealing σB* | σB/TS | Low-temperature toughness (° C.) vTrs (° C.) Formed into cross-sectional shape | After forming into cross-sectional shape and SR annealing | Remarks |
|---|---|---|---|---|---|
| 1 | 393 | 0.49 | −80 | −80 | Example |
| 2 | 421 | 0.51 | −70 | −75 | Example |
| 3 | 441 | 0.53 | −75 | −80 | Example |
| 4 | 391 | 0.50 | −75 | −80 | Example |
| 5 | 392 | 0.40 | −50 | −50 | Example |
| 6 | 396 | 0.52 | −90 | −90 | Example |
| 7 | 385 | 0.41 | −55 | −50 | Example |
| 8 | 406 | 0.45 | −50 | −50 | Example |
| 9 | 378 | 0.50 | −80 | −85 | Example |
| 10 | 434 | 0.51 | −75 | −70 | Example |
| 11 | 226 | 0.39 | −70 | −70 | Comparative Example |
| 12 | 357 | 0.35 | −35 | −35 | Comparative Example |
| 13 | 362 | 0.36 | −45 | −45 | Comparative Example |
| 14 | 329 | 0.38 | −35 | −35 | Comparative Example |
| 15 | 247 | 0.39 | −75 | −70 | Comparative Example |

*$\sigma_B$: $5 \times 10^5$ - cycle fatigue limit determined in torsional fatigue test subsequent to forming into cross-sectional V-shape

TABLE 4

| Steel Tube No. | Steel No. | Microstructure: Ferrite fraction (%) | Average grain size of ferrite (μm) | Average grain size of (Nb, Ti) composite carbide in ferrite phase (nm) | Tensile properties: TS (MPa) | YS (MPa) | EI [JIS #12 test specimen] (%) | Rate of change in cross-sectional hardness after forming into cross-sectional shape and SR annealing (%) | Rate of reduction in residual stress after forming into cross-sectional shape and SR annealing (%) |
|---|---|---|---|---|---|---|---|---|---|
| 16 | P | 35 | 5.7 | 6 | 1054 | 906 | 10 | −12 | 36 |
| 17 | Q | 88 | 9.6 | 50 | 731 | 658 | 14 | −20 | 55 |
| 18 | R | 85 | 6.2 | 12 | 796 | 709 | 14 | −11 | 58 |
| 19 | S | 87 | 8.5 | 25 | 766 | 689 | 14 | −20 | 54 |
| 20 | T | 75 | 2.6 | 24 | 1006 | 909 | 11 | −11 | 33 |
| 21 | U | 84 | 8.6 | 24 | 636 | 559 | 12 | −22 | 56 |
| 22 | V | 66 | 2.5 | 42 | 995 | 911 | 13 | −11 | 40 |
| 23 | W | 77 | 4.0 | 7 | 894 | 805 | 14 | −14 | 58 |
| 24 | X | 89 | 6.2 | 6 | 850 | 740 | 14 | −10 | 57 |
| 25 | Y | 72 | 3.6 | 11 | 911 | 866 | 12 | −12 | 48 |
| 26 | Z | 89 | 6.5 | 7 | 813 | 732 | 14 | −11 | 58 |
| 27 | AA | 72 | 4.0 | 6 | 857 | 814 | 12 | −10 | 44 |
| 28 | AB | 57 | 3.1 | 4 | 969 | 826 | 11 | −10 | 40 |
| 29 | AC | 54 | 3.9 | 7 | 930 | 837 | 14 | −12 | 39 |
| 30 | AD | 44 | 4.1 | 8 | 920 | 880 | 11 | −18 | 48 |
| 31 | AE | 56 | 4.3 | 7 | 855 | 770 | 14 | −11 | 45 |

| Steel Tube No. | Torsional fatigue endurance after forming into cross-sectional shape and SR annealing σB* | σB/TS | Low-temperature toughness (° C.) vTrs (° C.) Formed into cross-sectional shape | After forming into cross-sectional shape and SR annealing | Remarks |
|---|---|---|---|---|---|
| 16 | 358 | 0.34 | −30 | −35 | Comparative Example |
| 17 | 285 | 0.39 | −65 | −60 | Comparative Example |
| 18 | 294 | 0.37 | −35 | −35 | Comparative Example |
| 19 | 291 | 0.38 | −35 | −35 | Comparative Example |
| 20 | 362 | 0.36 | −35 | −30 | Comparative Example |
| 21 | 242 | 0.38 | −35 | −35 | Comparative Example |
| 22 | 358 | 0.36 | −35 | −35 | Comparative Example |

TABLE 4-continued

| | | | | | |
|---|---|---|---|---|---|
| 23 | 358 | 0.40 | −35 | −30 | Comparative Example |
| 24 | 323 | 0.38 | −35 | −35 | Comparative Example |
| 25 | 346 | 0.38 | −35 | −30 | Comparative Example |
| 26 | 276 | 0.34 | −30 | −30 | Comparative Example |
| 27 | 334 | 0.39 | −35 | −35 | Comparative Example |
| 28 | 358 | 0.37 | −35 | −35 | Comparative Example |
| 29 | 363 | 0.39 | −50 | −45 | Comparative Example |
| 30 | 359 | 0.39 | −45 | −45 | Comparative Example |
| 31 | 325 | 0.38 | −50 | −50 | Comparative Example |

*$\sigma_B$: $5 \times 10^5$ - cycle fatigue limit determined in torsional fatigue test subsequent to forming into cross-sectional V-shape Examples (Steel Tube Nos. 1 to 10) provide high-tensile strength welded steel tubes having high strength and excellent formability. The high-tensile strength welded steel tubes each contain a ferrite phase having a microstructure fraction of 60 volume percent or more and an average grain size of 2 μm to 8 μm, have a structure containing a (Nb, Ti) composite carbide having an average grain size of 2 nm to 40 nm, and have a yield strength YS of greater than 660 MPa. The JIS #12 test specimen taken from each of the high-tensile strength welded steel tubes has an elongation El of 15% or more. In the examples, the high-tensile strength welded steel tubes that are stress-relief annealed have a rate of change in cross-sectional hardness of −15% or more, a rate of reduction in residual stress of 50% or more, and a $\sigma_B$/Ts ratio of 0.40 or more, wherein $\sigma_B$ represents the $5\times10^5$-cycle fatigue limit of each high-tensile strength welded steel tube tested by the torsional fatigue test and TS represents the tensile strength thereof. Therefore, the high-tensile strength welded steel tubes have excellent torsional fatigue endurance. In the examples, the high-tensile strength welded steel tubes that are formed into cross-sectional shape and the high-tensile strength welded steel tubes that are formed into cross-sectional shape and then stress-relief annealed have a fracture appearance transition temperature v.Trs of −40° C. or less and therefore are excellent in low-temperature toughness.

On the other hand, comparative examples (Steel Tube Nos. 11 to 31) in which the content of a steel component is outside the scope of this disclosure have microstructures and the like outside the scope of this disclosure. The steel tubes that are stress-relief annealed have low torsional fatigue endurance. The steel tubes that are formed into cross-sectional shape have low low-temperature toughness. The steel tubes that are stress-relief annealed have low low-temperature toughness.

Comparative examples (Steel Tube Nos. 12, 16, 20, 22, 25, 27, and 28) in which the content of C, Mn, Ti, Nb, N, V, or Cr is high and therefore is outside the scope of this disclosure have an elongation El of less than 15% and therefore are insufficient in ductility. The comparative examples have a $\sigma_B$/Ts ratio of less than 0.40 and therefore are low in torsional fatigue endurance. The comparative examples have a fracture appearance transition temperature vTrs of higher than −40° C. and therefore are low in low-temperature toughness. Comparative examples (Steel Tube Nos. 11, 13, 15, 17, 19, and 21) in which the content of C, Si, Mn, Al, Ti, or Nb is low and therefore is outside the scope of this disclosure have a rate of change in cross-sectional hardness of less than −15% after being stress-relief annealed and a $\sigma_B$/Ts ratio of less than 0.40 and therefore are low in torsional fatigue endurance.

Comparative examples (Steel Tube Nos. 29, 30, and 31) in which the content of Mo, B, or Cu is high and therefore is outside the scope of this disclosure have an elongation El of less than 15% and therefore are insufficient in ductility. The comparative examples have a rate of reduction in residual stress of less than 50% after being stress-relief annealed and a $\sigma_B$/Ts ratio of less than 0.40 and therefore are low in torsional fatigue endurance.

Comparative examples (Steel Tube Nos. 14, 18, 24, and 26) in which the content of Si, Al, S, or O is high and therefore is outside the scope of this disclosure have a $\sigma_B$/Ts ratio of less than 0.40 after being stress-relief annealed and therefore are low in torsional fatigue endurance.

A comparative example (Steel Tube No. 23) in which the content of P is high and therefore is outside the scope of this disclosure has an elongation El of less than 15% and therefore is insufficient in ductility. Furthermore, the comparative example has a fracture appearance transition temperature vTrs of higher than −40° C. and therefore is low in low-temperature toughness.

Steel Tube Nos. 1 to 31 except Steel Tube No. 14 have an arithmetic average roughness Ra of 0.7 μm to 1.8 μm, a maximum-height roughness Rz of 10 μm to 22 μm, and a ten-point average roughness $Rz_{JIS}$ of 7 μm to 15 μm and therefore are good in surface roughness. Steel Tube No. 14 has an arithmetic average roughness Ra of 1.6 μM, a maximum-height roughness Rz of 27 μm, and a ten-point average roughness $Rz_{JIS}$ of 21 μm. That is, the arithmetic average roughness and maximum-height roughness of Steel Tube No. 14 are good; however, the ten-point average roughness thereof is high.

Example 2

Steel materials (slabs) having the same composition as that of Steel No. B or C shown in Table 1 were each subjected to a hot-rolling step under conditions shown in Table 3, whereby hot-rolled steel strips were obtained. The hot-rolled steel strips were used as steel tube materials. Each hot-rolled steel strip was pickled and then slit into pieces having a predetermined width. The pieces were continuously roll-formed into open tubes. Each open tube was subjected to an electrically welded tube-making step such that the open tube was electrically welded by high-frequency resistance welding, whereby a welded steel tube (an outer diameter ϕ of 70 to 114.3 mm and a thickness t of 2.0 to 6.0 mm) was obtained. In the electrically welded tube-making step, the width reduction defined by Equation (1) was as shown in Table 3.

Test specimens were taken from the obtained welded steel tubes in the same manner as that described in Example 1 and then subjected to a microstructure observation test, a precipitate observation test, a tensile test, a surface roughness test, a torsional fatigue test, a low-temperature toughness test, a cross-sectional hardness measurement test subsequent to stress-relief annealing, and a residual stress measurement test subsequent to stress-relief annealing.

Obtained results are shown in Table 4.

TABLE 5

| Steel Tube No. | Steel No. | Conditions of hot-rolling step: Heating temperature (° C.) | Finish-rolling final temperature (° C.) | Annealing time between 650° C. and 750° C. (s) | Coiling temperature (° C.) | Transverse drawing ratio in electrically welded tube-making step (%) | Dimensions of steel tubes: Outer diameter (mm) | Thickness (mm) | Remarks |
|---|---|---|---|---|---|---|---|---|---|
| 32 | C | 1350 | 860 | 4 | 590 | 4 | 89.1 | 3.0 | Comparative example |
| 33 | C | 1240 | 870 | 5 | 590 | 4 | 89.1 | 3.0 | Example |
| 34 | C | 1150 | 860 | 6 | 590 | 4 | 89.1 | 3.0 | Comparative example |
| 35 | C | 1250 | 1000 | 6 | 595 | 4 | 89.1 | 3.0 | Comparative example |
| 36 | C | 1230 | 860 | 5 | 595 | 4 | 89.1 | 3.0 | Example |
| 37 | C | 1230 | 750 | 4 | 580 | 4 | 89.1 | 3.0 | Comparative example |
| 38 | C | 1260 | 850 | 0.5 | 585 | 4 | 89.1 | 3.0 | Comparative example |
| 39 | C | 1240 | 860 | 4 | 570 | 4 | 89.1 | 3.0 | Example |
| 40 | C | 1260 | 870 | 5 | 670 | 4 | 89.1 | 3.0 | Comparative example |
| 41 | C | 1270 | 840 | 8 | 630 | 4 | 89.1 | 3.0 | Example |
| 42 | C | 1230 | 830 | 4 | 590 | 4 | 89.1 | 3.0 | Example |
| 43 | C | 1250 | 860 | 5 | 550 | 4 | 89.1 | 3.0 | Example |
| 44 | C | 1270 | 850 | 5 | 500 | 4 | 89.1 | 3.0 | Comparative example |
| 45 | B | 1230 | 880 | 66 | 590 | 0.5 | 89.1 | 3.0 | Example |
| 46 | B | 1240 | 870 | 5 | 595 | 2 | 89.1 | 3.0 | Example |
| 47 | B | 1250 | 870 | 5 | 590 | 4 | 89.1 | 3.0 | Example |
| 48 | B | 1240 | 870 | 4 | 585 | 4 | 70 | 2.0 | Example |
| 49 | B | 1240 | 860 | 5 | 590 | 4 | 101.6 | 4.0 | Example |
| 50 | B | 1250 | 880 | 6 | 585 | 4 | 114.3 | 6.0 | Example |
| 51 | B | 1250 | 890 | 4 | 595 | 8 | 89.1 | 3.0 | Example |
| 52 | B | 1240 | 840 | 6 | 595 | 12 | 89.1 | 3.0 | Comparative example |

TABLE 6

| Steel Tube No. | Steel No. | Microstructure: Ferrite fraction (%) | Average grain size of ferrite (μm) | Average grain size of (Nb, Ti) composite carbide in ferrite phase (nm) | Tensile properties: TS (MPa) | YS (MPa) | EI [JIS #12 test specimen] (%) | Rate of change in cross-sectional hardness after forming into cross-sectional shape and SR annealing (%) | Rate of reduction in residual stress after forming into cross-sectional shape and SR annealing (%) |
|---|---|---|---|---|---|---|---|---|---|
| 32 | C | 79 | 8.7 | 11 | 802 | 745 | 18 | −2 | 58 |
| 33 | C | 84 | 3.1 | 6 | 827 | 731 | 18 | 6 | 72 |
| 34 | C | 81 | 4.7 | 41 | 736 | 625 | 19 | −18 | 70 |
| 35 | C | 51 | 8.6 | 9 | 894 | 805 | 14 | −6 | 66 |
| 36 | C | 82 | 3.2 | 5 | 848 | 737 | 18 | 3 | 70 |
| 37 | C | 77 | 1.6 | 42 | 764 | 711 | 14 | −22 | 52 |
| 38 | C | 51 | 9.9 | 3 | 1011 | 910 | 11 | −18 | 52 |
| 39 | C | 82 | 3.3 | 6 | 816 | 718 | 18 | 5 | 71 |
| 40 | C | 77 | 8.9 | 50 | 768 | 668 | 14 | −19 | 53 |
| 41 | C | 80 | 6.1 | 30 | 888 | 689 | 16 | −8 | 58 |
| 42 | C | 83 | 3.0 | 7 | 823 | 738 | 18 | 5 | 70 |
| 43 | C | 61 | 2.6 | 2.5 | 969 | 850 | 16 | −10 | 58 |
| 44 | C | 49 | 2.1 | 1.3 | 1047 | 941 | 10 | −18 | 45 |
| 45 | B | 79 | 3.4 | 7 | 797 | 668 | 18 | −13 | 58 |
| 46 | B | 77 | 3.3 | 6 | 818 | 731 | 18 | 0 | 61 |
| 47 | B | 77 | 3.5 | 7 | 832 | 749 | 18 | 3 | 66 |
| 48 | B | 77 | 3.2 | 6 | 819 | 741 | 18 | 2 | 67 |
| 49 | B | 78 | 3.4 | 7 | 816 | 738 | 18 | 4 | 66 |
| 50 | B | 78 | 3.3 | 6 | 809 | 731 | 18 | 2 | 68 |
| 51 | B | 78 | 3.2 | 6 | 865 | 796 | 16 | 1 | 62 |
| 52 | B | 79 | 3.2 | 6 | 896 | 852 | 10 | −10 | 37 |

TABLE 6-continued

| Steel Tube No. | Torsional fatigue endurance after forming into cross-sectional shape and SR annealing σB* | σB/TS | Low-temperature toughness (° C.) vTrs (° C.) Formed into cross-sectional shape | After forming into cross-sectional shape and SR annealing | Roughness of inner and outer surfaces Arithmetic average roughness Ra (μm) | Maximum-height roughness Rz (μm) | Ten-point average roughness RzJIS (μm) | Remarks |
|---|---|---|---|---|---|---|---|---|
| 32 | 313 | 0.39 | −35 | −35 | 1.2 | 16 | 11 | Comparative example |
| 33 | 438 | 0.53 | −80 | −85 | 0.9 | 12 | 7 | Example |
| 34 | 287 | 0.39 | −80 | −85 | 1.0 | 14 | 10 | Comparative example |
| 35 | 331 | 0.37 | −50 | −45 | 2.2 | 33 | 22 | Comparative example |
| 36 | 441 | 0.52 | −85 | −85 | 0.8 | 11 | 7 | Example |
| 37 | 298 | 0.39 | −60 | −55 | 1.1 | 19 | 14 | Comparative example |
| 38 | 394 | 0.39 | −50 | −45 | 1.0 | 18 | 13 | Comparative example |
| 39 | 425 | 0.52 | −80 | −85 | 0.9 | 13 | 8 | Example |
| 40 | 284 | 0.37 | −50 | −50 | 2.3 | 31 | 21 | Comparative example |
| 41 | 327 | 0.42 | −70 | −65 | 1.8 | 2 | 14 | Example |
| 42 | 436 | 0.53 | −80 | −85 | 0.9 | 12 | 8 | Example |
| 43 | 416 | 0.43 | −50 | −50 | 1.1 | 15 | 10 | Example |
| 44 | 366 | 0.35 | −35 | −35 | 1.2 | 17 | 13 | Comparative example |
| 45 | 343 | 0.43 | −80 | −80 | 1.0 | 14 | 10 | Example |
| 46 | 409 | 0.50 | −80 | −80 | 0.9 | 14 | 9 | Example |
| 47 | 433 | 0.52 | −85 | −80 | 0.9 | 13 | 9 | Example |
| 48 | 434 | 0.53 | −75 | −80 | 0.8 | 21 | 8 | Example |
| 49 | 425 | 0.52 | −75 | −80 | 0.8 | 13 | 1 | Example |
| 50 | 420 | 0.52 | −80 | −75 | 0.9 | 13 | 8 | Example |
| 51 | 432 | 0.50 | −60 | −60 | 0.9 | 14 | 8 | Example |
| 52 | 349 | 0.39 | −35 | −35 | 0.9 | 13 | 7 | Comparative example |

*$\sigma_B$: $5 \times 10^5$ - cycle fatigue limit determined in torsional fatigue test subsequent to forming into cross-sectional V-shape Examples (Steel Tube Nos. 33, 36, 39, 41 to 43, and 45 to 51) provide high-tensile strength welded steel tubes having high strength and excellent formability. The high-tensile strength welded steel tubes each contain a ferrite phase having a microstructure fraction of 60 volume percent or more and an average grain size of 2 μm to 8 μm, have a structure containing a (Nb, Ti) composite carbide having an average grain size of 2 nm to 40 nm, and have a yield strength YS of greater than 660 MPa. A JIS #12 test specimen taken from each of the high-tensile strength welded steel tubes has an elongation El of 15% or more. In the examples, the high-tensile strength welded steel tubes that are stress-relief annealed (530° C.×10 min) have a rate of change in cross-sectional hardness of −15% or more, a rate of reduction in residual stress of 50% or more, and a $\sigma_B$/Ts ratio of 0.40 or more after being stress-relief annealed (530° C.×10 min), wherein $\sigma_B$ represents the $5\times10^5$-cycle fatigue limit of each high-tensile strength welded steel tube tested by a torsional fatigue test and TS represents the tensile strength thereof. Therefore, the high-tensile strength welded steel tubes have excellent torsional fatigue endurance. In the examples, the high-tensile strength welded steel tubes that are formed into cross-sectional shape and the high-tensile strength welded steel tubes that are formed into cross-sectional shape and then stress-relief annealed have a fracture appearance transition temperature vTrs of 40° C. or less and therefore are excellent in low-temperature toughness.

On the other hand, comparative examples (Steel Tube Nos. 32, 34, 35, 37, 38, 40, 44, and 52) in which conditions of the hot-rolling step of rolling each steel material or conditions of the electrically welded tube-making step of making each steel tube are outside the scope of this disclosure are low in strength, formability, torsional fatigue endurance after being stress-relief annealed, low-temperature toughness after being formed into cross-sectional shape, or low-temperature toughness after being stress-relief annealed.

Comparative examples (Steel Tube Nos. 38 and 44) in which slow cooling conditions and a coiling temperature in the hot-rolling step are outside the scope of this disclosure have high strength, an elongation El of less than 15%, and a $\sigma_B$/Ts ratio of less than 0.40. Therefore, the comparative examples have low formability and low torsional fatigue endurance after being stress-relief annealed.

Comparative examples (Steel Tube Nos. 35 and 40) in which a finish-rolling final temperature and coiling temperature in the hot-rolling step are high and therefore are outside the scope of this disclosure have an elongation El of less than 15% and a $\sigma_B$/Ts ratio of less than 0.40 and do not meet the following requirements: an arithmetic average roughness Ra of 2 μm or less, a maximum-height roughness Rz of 30 μm or less, and a ten-point average roughness $Rz_{JIS}$ of 20 μm or less. Therefore, the comparative examples have low formability, insufficient surface properties, and low torsional fatigue endurance after being stress-relief annealed.

Comparative examples (Steel Tube Nos. 32 and 52) in which the heating temperature of each steel material and a width reduction in the electrically welded tube-making step are high and therefore are outside the scope of this disclosure have a $\sigma_B$/Ts ratio of less than 0.40 and a fracture appearance transition temperature vTrs of higher than −40° C. Therefore, the comparative examples have low torsional fatigue endurance and low low-temperature toughness after being stress-relief annealed.

Comparative examples (Steel Tube Nos. 34 and 37) in which the heating temperature and finish-rolling final temperature of each steel material are low and therefore are outside the scope of this disclosure have a $\sigma_B$/Ts ratio of less than 0.40 and therefore are low in torsional fatigue endurance after being stress-relief annealed.

The invention claimed is:

1. A high-tensile strength welded steel tube, having excellent low-temperature toughness, formability, and torsional fatigue endurance after being stress-relief annealed, for structural parts of automobiles, the tube having a composition which contains 0.03% to 0.24% C, 0.002% to 0.95% Si, 1.01% to 1.99% Mn, and 0.01% to 0.08% Al, which further contains 0.041% to 0.150% Ti and 0.017% to 0.150% Nb such that the sum of the content of Ti and that of Nb is 0.08% or more, and which further contains 0.019% or less P, 0.020% or less S, 0.01.0% or less N, and 0.005% or less O on a mass basis, the remainder being Fe and unavoidable impurities, P, S, N, and O being impurities; a microstructure containing a ferrite phase and a second phase other than the ferrite phase; and a yield strength of greater than 660 MPa, wherein the ferrite phase has an average grain size of 2 μm to 8 μm in circumferential cross section and a microstructure fraction of 60 volume percent or more and contains a precipitate of a (Nb, Ti) composite carbide having an average grain size of 2 to 40 nm.

2. The high-tensile strength welded steel tube according to claim 1, wherein the composition further contains one or more selected from the group consisting of 0.001% to 0.150% V, 0.001% to 0.150% W, 0.001% to 0.45% Cr, 0.0001% to 0.0009% B, 0.001% to 0.45% Cu, and 0.001% to 0.45% Ni and/or 0.0001% to 0.005% Ca on a mass basis.

3. The high-tensile strength welded steel tube according to claim 1, wherein the inner and outer surfaces of the tube have an arithmetic average roughness Ra of 2 μm or less, a maximum-height roughness Rz of 30 μm or less, and a ten-point average roughness $Rz_{JIS}$ of 20 μm or less.

4. The high-tensile strength welded steel tube according to claim 2, wherein the inner and outer surfaces of the tube have an arithmetic average roughness Ra of 2 μm or less, a maximum-height roughness Rz of 30 μm or less, and a ten-point average roughness $Rz_{JIS}$ of 20 μm or less.

5. A method of producing a high-tensile strength welded steel tube having a yield strength of greater than 660 MPa, excellent low-temperature toughness, excellent formability, and excellent torsional fatigue endurance after being stress-relief annealed, for structural parts of automobiles, the method comprising an electrically welded tube-making step of forming a steel tube material into a welded steel tube, wherein the steel tube material is a hot-rolled steel strip that is obtained in such a manner that a steel material is subjected to a hot-rolling step including a hot-rolling sub-step of heating the steel material to a temperature 1160° C. to 1320° C. and then finish-rolling the steel material at a temperature of 760° C. to 980° C., a slow cooling sub-step of slow cooling the rolled steel material at a temperature of 650° C. to 750° C. for 2 s or more, and a coiling sub-step of coiling the annealed steel material at a temperature of 510° C. to 660° C.; the steel material has a composition which contains 0.03% to 0.24% C, 0.002% to 0.95% Si, 1.01% to 1.99% Mn, and 0.01% to 0.08% Al, which further contains 0.041% to 0.150% Ti and 0.017% to 0.150% Nb such that the sum of the content of Ti and that of Nb is 0.08% or more, and which further contains 0.019% or less P, 0.020% or less S, 0.010% or less N, and 0.005% or less O on a mass basis, the remainder being Fe and unavoidable impurities, P, S, N, and O being impurities; the electrically welded tube-making step includes a tube-making step of continuously roll-forming the steel tube material at a width reduction of 10% or less and then electrically welding the steel tube material into the welded steel tube; and the width reduction of the steel tube material is defined by the following equation:

$$\text{width reduction (\%)}=[(\text{width of steel tube material})-\pi\{(\text{outer diameter of product})-(\text{thickness of product})\}]/\pi\{(\text{outer diameter of product})-(\text{thickness of product}))\}\times(100\%) \quad (1).$$

6. The high-tensile strength welded steel tube-producing method according to claim 5, wherein the composition further contains one or more selected from the group consisting of 0.001% to 0.150% V, 0.001% to 0.150% W, 0.001% to 0.45% Cr, 0.0001% to 0.0009% B, 0.001% to 0.45% Cu, and 0.001% to 0.45% Ni and/or 0.0001% to 0.005% Ca on a mass basis.

* * * * *